US010633910B2

(12) United States Patent
Salter et al.

(10) Patent No.: US 10,633,910 B2
(45) Date of Patent: Apr. 28, 2020

(54) VEHICLE DOOR HAVING VARIABLE SPEED POWER ASSIST

(71) Applicant: Ford Global Technologies, LLC, Dearborn, MI (US)

(72) Inventors: Stuart C. Salter, White Lake, MI (US); Kosta Papanikolaou, Huntington Woods, MI (US); Paul Kenneth Dellock, Northville, MI (US); David Brian Glickman, Southfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 202 days.

(21) Appl. No.: 15/981,119

(22) Filed: May 16, 2018

(65) Prior Publication Data

US 2019/0352954 A1 Nov. 21, 2019

(51) Int. Cl.
*E05F 15/73* (2015.01)
*E05B 81/76* (2014.01)

(52) U.S. Cl.
CPC ..... *E05F 15/73* (2015.01); *E05B 81/77* (2013.01); *E05Y 2400/36* (2013.01); *E05Y 2400/856* (2013.01); *E05Y 2900/531* (2013.01)

(58) Field of Classification Search
CPC ..... E05F 15/73; E05B 81/77; E05B 85/10; E05Y 2400/856; E05Y 2201/68
See application file for complete search history.

(56) References Cited

U.S. PATENT DOCUMENTS

| | | | |
|---|---|---|---|
| 7,911,321 | B2 | 3/2011 | Bingle et al. |
| 8,091,280 | B2 | 1/2012 | Hanzel et al. |
| 8,471,822 | B2 | 6/2013 | Lightenberg |
| 8,701,353 | B2 | 4/2014 | Patel et al. |
| 8,922,340 | B2 | 12/2014 | Salter et al. |
| 9,137,856 | B2 | 9/2015 | Thompson et al. |
| 9,151,089 | B2 | 10/2015 | Aerts et al. |
| 9,346,470 | B2 | 5/2016 | Mittermeier |
| 9,423,895 | B2 | 8/2016 | Adamson et al. |
| 9,447,613 | B2 | 9/2016 | Salter et al. |
| 9,512,662 | B1 | 12/2016 | Dudar et al. |
| 9,637,088 | B2 | 5/2017 | Ette et al. |
| 9,646,436 | B1 | 5/2017 | Campbell et al. |

(Continued)

FOREIGN PATENT DOCUMENTS

| | | |
|---|---|---|
| CN | 202261842 U | 5/2012 |
| CN | 205086649 U | 3/2016 |

(Continued)

OTHER PUBLICATIONS

JP-2002242533 Translation (Year: 2002).*

(Continued)

*Primary Examiner* — Justin B Rephann
(74) *Attorney, Agent, or Firm* — David Coppiellie; Price Heneveld LLP

(57) ABSTRACT

A vehicle door is provided that includes a door panel, a door handle located on the panel and having a contact surface, and one or more proximity sensors located on the handle to sense a user's hand interfacing with the handle. The vehicle door also includes an actuator for actuating the door panel, and a controller configured to control the actuator to open the door open position at a speed that varies based on the sensed user hand contacting the contact surface.

18 Claims, 4 Drawing Sheets

(56) References Cited

U.S. PATENT DOCUMENTS

| | | | | |
|---|---|---|---|---|
| 9,696,839 | B1 | 7/2017 | Bingle et al. | |
| 9,745,778 | B1 | 8/2017 | Bingle | |
| 10,124,767 | B1 | 11/2018 | Salter et al. | |
| 10,378,254 | B1 * | 8/2019 | Salter | E05B 81/76 |
| 10,378,265 | B2 * | 8/2019 | Watanabe | E05F 15/614 |
| 2003/0029210 | A1 | 2/2003 | Budzynski et al. | |
| 2006/0071755 | A1 | 4/2006 | Muller et al. | |
| 2007/0194878 | A1 | 8/2007 | Touge et al. | |
| 2007/0296242 | A1 * | 12/2007 | Frommer | E05F 15/43 296/146.4 |
| 2008/0061933 | A1 * | 3/2008 | Ieda | B60R 25/246 340/5.72 |
| 2011/0148575 | A1 | 6/2011 | Sobecki et al. | |
| 2012/0119524 | A1 | 5/2012 | Bingle et al. | |
| 2013/0033362 | A1 | 2/2013 | Hourne | |
| 2013/0244577 | A1 | 9/2013 | Cheikh | |
| 2014/0000165 | A1 | 1/2014 | Patel et al. | |
| 2014/0000167 | A1 | 1/2014 | Patel et al. | |
| 2014/0069015 | A1 | 3/2014 | Salter et al. | |
| 2015/0315839 | A1 | 11/2015 | Shigemoto et al. | |
| 2015/0330112 | A1 | 11/2015 | Van Wiemeersch et al. | |
| 2015/0330117 | A1 | 11/2015 | Van Wiemeersch et al. | |
| 2016/0251880 | A1 | 9/2016 | Bingle et al. | |
| 2016/0333627 | A1 | 11/2016 | Dudar et al. | |
| 2017/0016255 | A1 | 1/2017 | Guibbert et al. | |
| 2017/0103592 | A1 | 4/2017 | Buttolo et al. | |
| 2017/0194960 | A1 | 7/2017 | Bextermoeller et al. | |
| 2017/0232932 | A1 | 8/2017 | Nishidai et al. | |
| 2017/0260778 | A1 | 9/2017 | Witte et al. | |
| 2018/0283843 | A1 | 10/2018 | Adams et al. | |
| 2019/0299847 | A1 * | 10/2019 | Mori | E05F 15/73 |
| 2020/0011096 | A1 * | 1/2020 | Leonardi | E05B 81/76 |

FOREIGN PATENT DOCUMENTS

| | | | |
|---|---|---|---|
| CN | 107575101 | A | 1/2018 |
| DE | 102006019581 | B4 | 11/2014 |
| DE | 102013013203 | A1 | 2/2015 |
| JP | 2002242533 | A * | 8/2002 |
| JP | 2008063907 | A | 3/2008 |
| JP | 4146601 | B2 | 6/2008 |
| JP | 4161898 | B2 | 8/2008 |
| JP | 2009079353 | A | 4/2009 |
| JP | 5309515 | B2 | 7/2013 |
| KR | 1020130094569 | A | 8/2013 |

OTHER PUBLICATIONS

U.S. Appl. No. 15/882,191, filed Jan. 29, 2018, entitled "Vehicle Exterior Keypad Having Interior Lamp," 4 pages of filing receipt, 13 pages of patent application and 6 pages of drawings.

Tesla Model S—Cold Weather Performance, Published Nov. 22, 2013 on YouTube, https://www.youtube.com/watch?v=GS9uDJGi52A&feature=c4-overview&list=UU5WjFrtBdufl6CZojX3D8dQ, 3 pages.

How to—Range Rover Velar (2017) Vehicle Feature: Gesture Tailgate, Published Jul. 14, 2017 on YouTube, https://www.youtube.com/watch?v=RjhYd2b1ZIE, 1 page.

"Touch Sensors Design Guide" by ATMEL, 10620 D-AT42-04/09, Revised Apr. 2009, 72 pages, Copyrighted 2008-2009 Atmel Corporation.

* cited by examiner

VEHICLE DOOR HAVING VARIABLE SPEED POWER ASSIST

FIELD OF THE INVENTION

The present invention generally relates to powered vehicle doors, and more particularly relates to a powered vehicle door having variable speed power assist based on a user input sensed via proximity sensing.

BACKGROUND OF THE INVENTION

Automotive vehicles include various door assemblies for allowing access to the vehicle, such as passenger doors allowing access to the passenger compartment. The vehicle doors typically include a door handle and a latch assembly that latches the door in the closed position and is operable by a user to unlatch the door to allow the door to open. The doors may pivot or slide on a track between open and closed positions. Some vehicle doors are equipped with a motor to provide power door opening assist to open the door. Upon receiving the user input, the motor actuates the door to the open position typically at a constant speed. It is desirable to provide for a power door opening assist that provides enhanced functionality.

SUMMARY OF THE INVENTION

According to one aspect of the present invention, a variable-speed powered door is provided. The variable-speed powered door includes a door panel, a door handle located on the panel and having a contact surface, a proximity sensor arrangement located on the handle to sense a user's hand interfacing with the handle, and an actuator actuating the door panel to an open position at a speed that varies based on the sensed user hand contacting the contact surface.

Embodiments of the first aspect of the invention can include any one or a combination of the following features:

- the actuator actuates the door at a first speed when a first size contact area is sensed and at a greater second speed when a greater second size contact area is sensed;
- the actuator actuates the door at a third speed when a third size contact area is sensed;
- the powered door further includes a latch, wherein the latch is unlocked when an initial contact is sensed;
- the powered door further includes a controller configured to process one or more signals sensed by the one or more proximity sensors to detect the contact and control the actuator based on the detected contact;
- the proximity sensor comprises one or more capacitive sensors;
- the one or more capacitive sensors comprises a plurality of capacitive sensors;
- the proximity sensor is configured to sense contact on the contact surface on an inside surface of the handle;
- the door is located on a vehicle; and
- the door handle is located on the exterior side of the door panel.

According to another aspect of the present invention, a vehicle door is provided. The vehicle door includes a door panel, a door handle located on the panel and having a contact surface, one or more proximity sensors located on the handle to sense a user's hand interfacing with the handle, an actuator for actuating the door panel, and a controller configured to control the actuator to open the door open position at a speed that varies based on the sensed user hand contacting the contact surface.

Embodiments of the second aspect of the invention can include any one or a combination of the following features:

- the actuator actuates the door at a first speed when a first contact area is sensed and at a greater second speed when a greater second size contact area is sensed;
- the actuator actuates the door at a third speed when a third size contact area is sensed;
- the door further includes a latch, wherein the latch is unlocked when an initial contact is sensed;
- the proximity sensor comprises one or more capacitive sensors;
- the one or more capacitive sensors comprises a plurality of capacitive sensors;
- the proximity sensor is configured to sense contact on the contact surface on an inside surface of the handle;
- the door is located on a motor vehicle;
- the door handle is located on the exterior side of the door panel; and
- the controller is configured to process one or more signals sensed by the one or more proximity sensors to detect contact with the contact surface.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
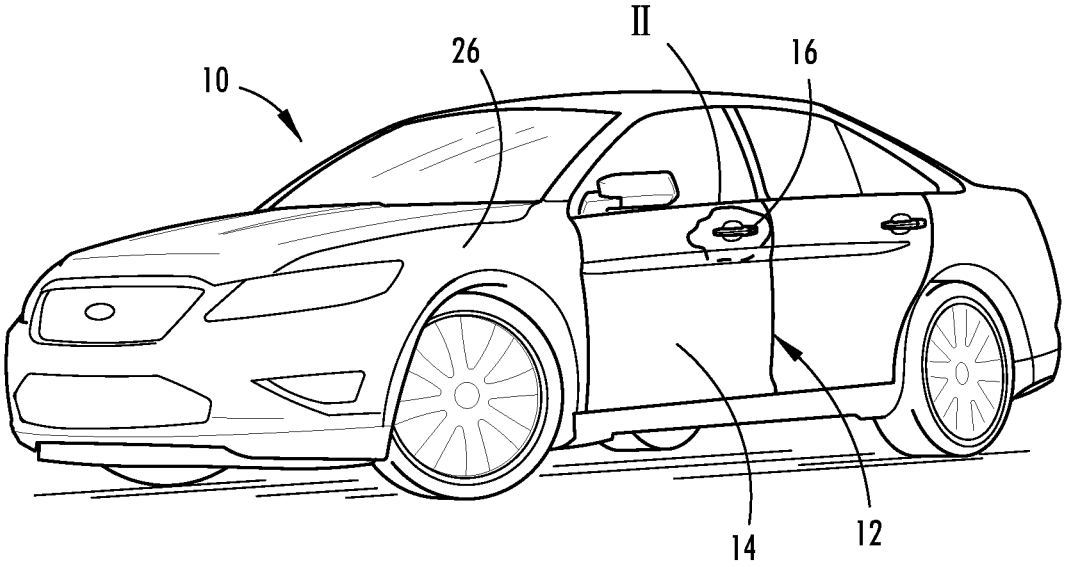
FIG. 1 is a side perspective view of a motor vehicle having doors equipped with a door handle having a variable speed power assist, according to one embodiment.

For purposes of description herein, the terms "upper," "lower," "right," "left," "rear," "front," "vertical," "horizontal," "interior," "exterior" and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
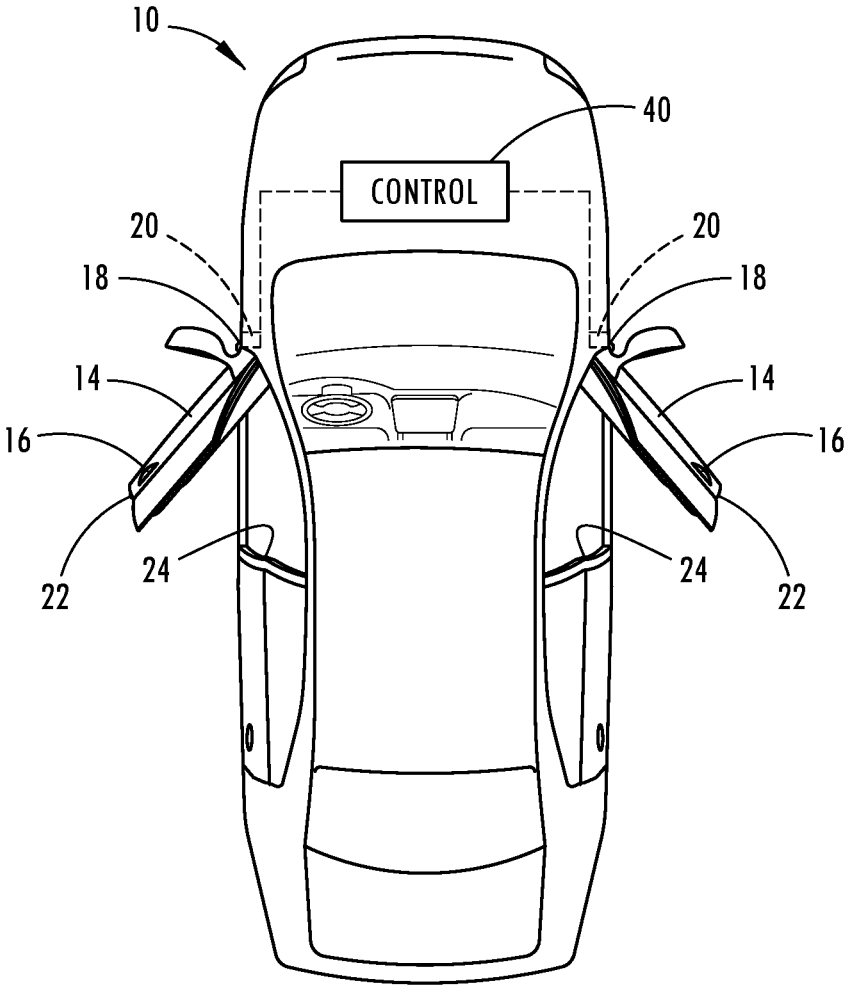
FIG. 2 is a top view of the vehicle further illustrating the two forwardmost powered doors in the open position.

Referring now to FIGS. 1 and 2, a wheeled motor vehicle 10 is generally illustrated having a plurality of variable-speed powered doors, according to one embodiment. The vehicle 10 includes vehicle doors 16 provided on opposite sides of the vehicle. In the embodiment shown, the vehicle 10 has a front door and rear door on the one side of the vehicle to enable the driver and passengers to enter and exit the seating compartment, and a front and rear door on the opposite side of the vehicle to enable passengers to access the seating compartment from that side. The vehicle doors 12 each include a door panel 14 pivotally connected to a body 26 of the vehicle 10. The connection between each door panel 14 and body 26 may include one or more hinge assemblies 18 that allow the door to swing about the hinge assembly 18 between the closed and open positions. While the doors 12 are pivoting doors in the embodiment shown, it should be appreciate that one or more of the doors could otherwise move between open and closed positions, such as sliding doors.

Each door 12 also includes a door handle 16 located on the exterior side of the door panel 14. The door handle 16 is configured such that a user may grip the handle 16 and the door handle 16 has a contact surface on the inside surface to enable a user to contact the door handle 16 to input a door unlatch command and to input a door open command. It should be appreciated that the door handle 16 may have other shapes, sizes and configurations.

The door 12 includes an actuator such as an electric motor 20 shown located near the hinge assembly 18. The motor 20 is actuatable in a first direction to open the door to an open position. The motor 20 may also be actuatable in the reverse second direction to close the door to a closed position. The actuator may operate at multiple speeds in response to a sensed user hand contacting the contact surface with a door speed control command. For example, the door panel 14 may be opened at a first slow speed, or a second middle or normal speed which is faster than the first speed, or a fast third speed which is faster than the second speed, depending on the amount of contact area sensed on the door handle by a proximity sensor arrangement.

The vehicle door 12 may further include a door latch lock assembly 22 configured to engage a latch mechanism 24 on the vehicle body when the door panel 14 is in the closed position. The latch assembly 22 may be electronically controlled to latch and unlatch the door based on a user input as sensed by the proximity sensor arrangement. For example, the latch assembly 22 may unlatch when a user's hand is detected or sensed contacting a contact surface on the door handle 16 and a vehicle key fob or other electronic device such as a smartphone is sensed in close proximity (e.g., within one meter) to the corresponding vehicle door 12. Once the door is unlatched, the door may be actuated to the open position. When the door is closed, the latch assembly 22 will latch onto latch mechanism 24 on the body 26 to keep the door 12 latched in the closed position. Various latch configurations may be used. It should be appreciated that the door latch assembly 22 may otherwise be controlled with a key fob or with user input controls provided on the vehicle.

Figure 3:
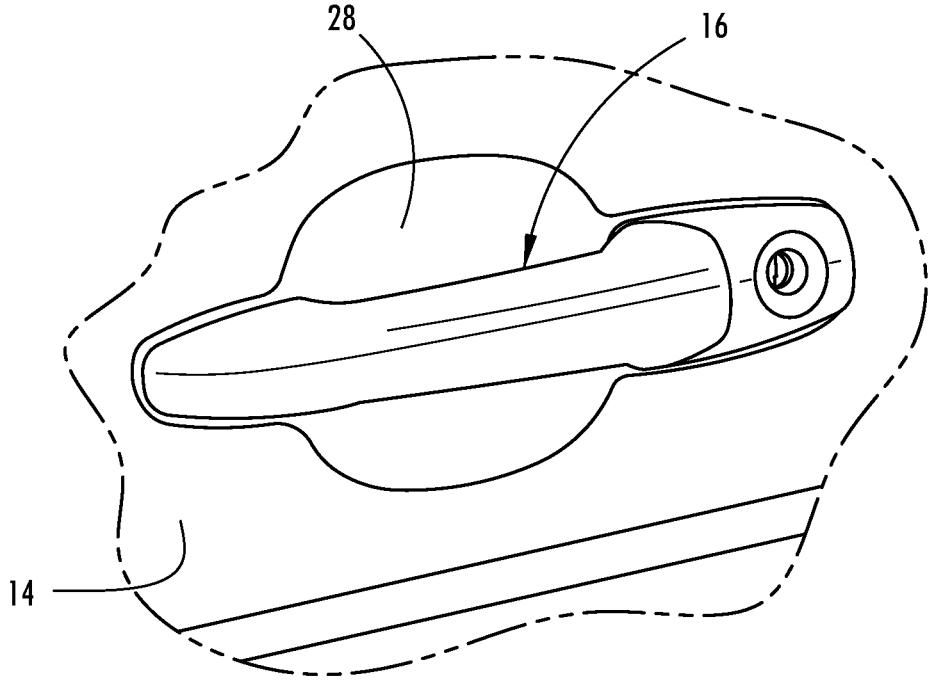
FIG. 3 is an enlarged view of section II of FIG. 1 further illustrating the vehicle door handle.
Figure 4:
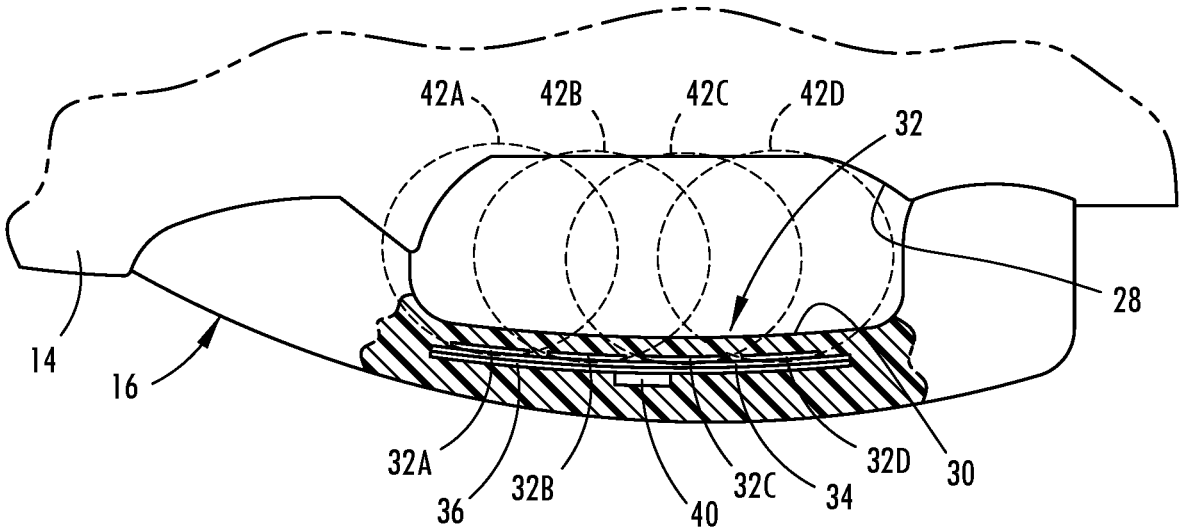
FIG. 4 is a partial cut-away view of the door handle shown in FIG. 3 illustrating proximity sensors located on the handle to sense a user's hand interfacing with the handle, according to one embodiment.

Referring to FIGS. 3 and 4, the door 12 and the door handle 16 are further illustrated in greater detail. The door handle 16 is shown located on the exterior surface of the door panel 14 and extends outward from a recess 28 formed in the door panel 14. The space between the recess 28 and the door handle 16 allows a user's hand to reach around the door handle 16 and grip the inside surface of the door handle 16 and contact a contact surface 30 on the inside surface of the door handle 16. The recess 28 in the door panel 14 enables the user's hand to extend further in the space without having the door handle 16 extend further out away from the vehicle.

The powered door 12 includes a proximity sensor arrangement 32 located on the door handle 16 and configured to sense a user's hand interfacing with the door handle 16, particularly on the contact surface 30 on the inside of the door handle 16. The proximity sensor arrangement 32 has one or more proximity sensors configured to sense a user in close proximity, e.g., within one millimeter, or in contact with the contact surface 30 on the door handle 16. In the embodiment shown, the proximity sensor arrangement 32 includes four proximity sensors 32A-32D shown evenly spaced along a length of the door handle 16 for generating corresponding sense activation fields 42A-42D. The sense activation fields 42A-42D are shown overlapping with one another and sufficiently covering the contact surface 30 and the space within the recess 28 between the door panel 14 and the door handle 16. Each of the proximity sensors 32A-32D generates a sense activation field 42A-42D and generates a signal in response to sensed interference with the corresponding sense activation field. The signal generated with each proximity sensor 32A-32D is processed by a controller to detect the presence of a user e.g., hand of a user, within the sense activation field and generates a signal amplitude dependent upon the amount of interference or contact with the contact surface 30 within the sense activation field. For example, when a user's hand lightly touches the inside surface of the door handle 16, a relatively smaller amplitude signal is generated, whereas if the user pulls on the inside surface of the door handle 16 on the contact surface 30, the amount of signal amplitude generated is greater.

The proximity sensors 32A-32C are located within a housing of the door handle 16 in close proximity to the contact surface 30. The door handle 16, particularly the inside contact surface 30, is preferably made of a material, such as polymeric material, that does not interfere with the sense activation fields 42A-42D. Each of the proximity sensors 32A-32D is located on a printed circuit board 34 which may include other electrical circuitry. The printed circuit board 34 includes a controller in the form of a microprocessor 40 which may be electrically connected to the proximity sensors 32A-32D and may process the signal generated by each of the sensors. It should be appreciated that each of the proximity sensors 32A-32D are located on one side of the printed circuit board 34 facing towards the contact surface 30 on the inside of the handle 16. A ground layer 36 is disposed on the opposite side of the printed circuit board 34 and thus is located on the side of the circuit board 34 towards the exterior of the door handle 16. The ground layer 36 is made of an electrically conductive material that is grounded to an electrical ground. The ground layer 36 prevents the sense activation fields 42A-42D generated by each of the sensors 32A-32D from extending towards the exterior side of the handle 16 while allowing the sense activation fields 42A-42D to extend towards the interior side of the handle 16 where the contact surface 30 is located.

In the embodiment shown, the plurality of proximity sensors 32A-32D includes a linear array of four sensors, however, it should be appreciated that one or more proximity sensors may be employed in the array of proximity sensors. Additionally, it should be appreciated that the array of proximity sensors 32A-32D is configured to sense the proximity of objects located on an inside portion of the handle 16 at or near the contact surface 30 on the inside of the door handle 16, according to one embodiment. However, it should be appreciated that the array of proximity sensors 32A-32D may be provided on a different side of the door handle 16, according to other embodiments. It should further be appreciated that the variable-speed powered door 12 may be implemented on any side door of the vehicle or another door of the vehicle, such as a vehicle tailgate or an interior door handle according to other embodiments.

The proximity sensors 32A-32D are shown and described herein as capacitive sensors, according to one embodiment. Each capacitive sensors includes at least one capacitive sensors that provides a sense activation field 42A-42D to sense contact or close proximity (e.g., within one millimeter) of an object, such as the hand (e.g., palm and/or fingers) of a user or operator in relation to the one or more proximity sensors 32A-32D. The capacitive sensors may operate as a capacitive switch that may unlatch the door latch and may operate as a switch input to control the variable-speed of the door motor for opening the door. In this embodiment, the sense activation field of each proximity sensor is a capacitive field and the user's hand, including the palm, thumb and other fingers, has electrical conductivity and dielectric properties that cause a change or disturbance in the sense activation field as should be evident to those skilled in the art. However, it should be appreciated by those skilled in the art that additional or alternative types of proximity sensors can be used, such as, but not limited to inductive sensors, optical sensors, temperature sensors, resistive sensors, the like or a combination thereof. Exemplary proximity sensors are described in the Apr. 9, 2009, ATMEL® Touch Sensors Design Guide, 10620 D-AT42-04/09, the entire reference hereby being incorporated herein by reference.

Each of the capacitive sensors may be configured with electrical circuitry that may be printed with printed ink on a substrate and generally includes a drive electrode and a receive electrode, each having interdigitated fingers for generating a capacitive field, according to one embodiment. It should be appreciated that each of the proximity sensors 32A-32D may otherwise be formed. Each capacitive sensor may have a drive electrode that typically receives a square wave drive pulse applied at a voltage and a receive electrode that has an output for generating an output voltage. It should be appreciated that the electrodes may be arranged in various configurations for generating the capacitive field as the sense activation field.

In one embodiment, the drive electrode of each proximity sensor is applied with a voltage input as square wave pulses having a charge pulse cycle sufficient to charge the receive electrode to a desired voltage. The receive electrode thereby serves as a measurement electrode. When a user or operator, such as a user's hand or thumb or other fingers, enters a sense activation field associated with one of the sensors, the disturbance caused by the hand or fingers to the activation field is detected and a signal is generated. Each of the signals is processed by a controller to determine whether or not to unlock or unlatch the door latch and whether to control the actuator to control the opening speed of the door at a high, medium or low speed according to one embodiment. The disturbance of each sense activation field is detected by processing a charge pulse signal associated with the corresponding signal channel. When the user's hand or fingers enter the sense activation field, the disturbance of each sense activation field is processed via separate signal channels.

The sense activation fields 42A-42D generated by each individual proximity sensor is shown in FIG. 4 slightly overlapping, however, it should be appreciated that the sense activation fields may be smaller or larger and may overlap more or less depending on the sensitivity of the individual sense activation fields. By employing a plurality of sense activation fields on the interior side of the handle 16 in close proximity to the contact surface 30, the size and shape of the hand and the amount of gripping contact with the contact surface 30 may be determined based on the sensed signals. The amplitude of each signal may vary based on the size of the hand and the amount of contact on the contact surface 30 where the sense activation field is located. Additionally, the amount of contact on the contact surface 30 extending throughout the entire interior surface of the handle 16 may be determined by processing the signals that are generated with all four capacitive sensors. The sum total of the signals or an average value of the signals generated by the capacitive sensors may be processed to determine the contact area and the user input command. Thus, one or all of the proximity sensors 32A-32D may sense the size of the contact area engaged by a user's hand.

When an initial contact or close contact of a hand is made with the handle 16, an initial signal level may be established which may be used to unlatch the door. According to one embodiment, an initial level is established when the user inputs a door unlatch command. However, the initial signal level may be entered at other contact forces. Once unlatched, the door may be controlled to open with the actuator assist based on a user's input applied by the hand contacting the contact surface 30 of the door handle 16. The actuator actuates the door opening at a first speed when a greater first size contact area is sensed relative to the initial contact. The actuator is controlled to actuate the door opening at a greater second speed when a greater second size contact area is sensed relative to the initial contact. The actuator is further controlled to actuate the door opening at a third speed when a larger third size contact area is sensed relative to the initial contact. Thus, a user may grab the handle 16 and unlock or unlatch the door, and then may proceed to apply a desired amount of force onto the contact surface 30 by gripping the handle 16 which flattens the hand and increases the contact area applied to the contact surface 30 on the inside of the handle. The change in the sensed contact area is used to control the speed of the opening of the door with the actuator. By pulling on the door lightly, the first contact area is achieved, whereas by pulling on the door with a greater amount of force resulting in a greater contact with the contact surface 30 of the handle 16, a greater door opening speed may be achieved. By pulling even harder on the door with a greater force in a further enhanced contact surface may be achieved which causes yet a greater door opening speed.

Figure 5:
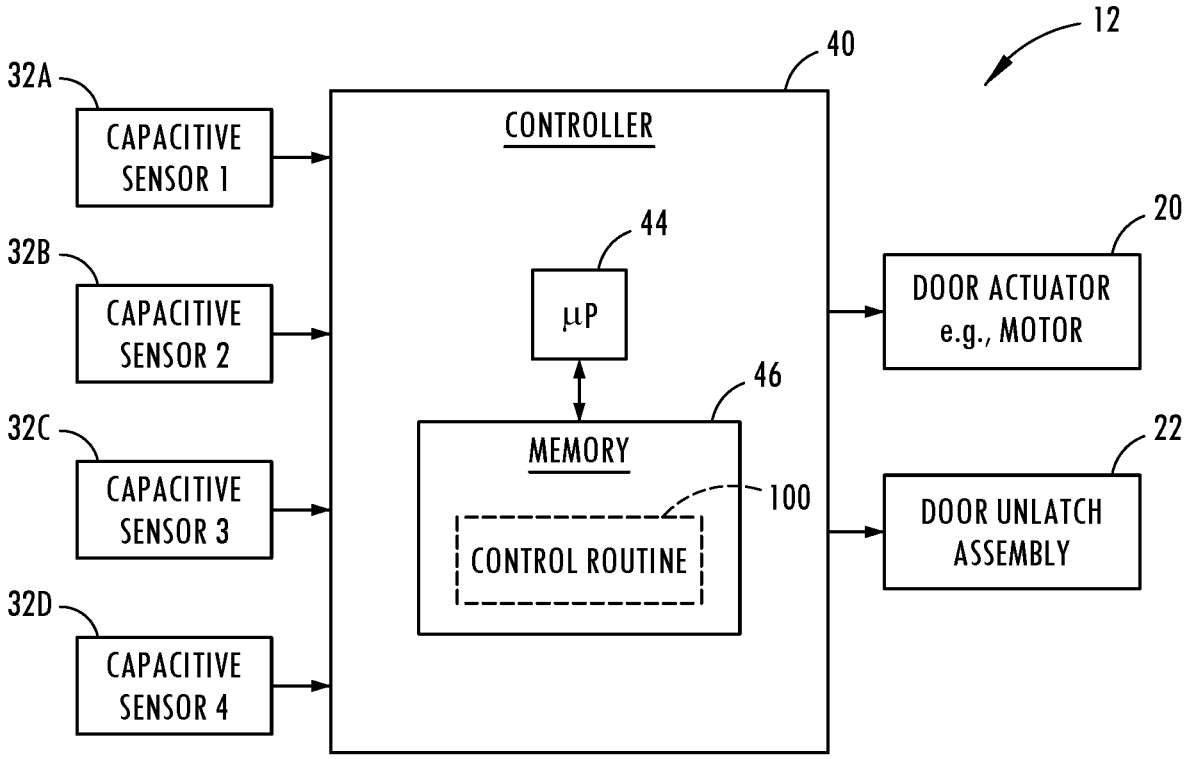
FIG. 5 is a block diagram illustrating controls for processing the proximity sensors associated with the door handle and controlling the door unlock and actuator motor.

Referring to FIG. 5, the controller 40 for controlling the door latch assembly 22 and door actuator 20 for variable-speed door opening control of one of the doors is illustrated. The controller 40 may include a microprocessor 40 and memory 46. It should be appreciated that the controller 40 may include analog and/or digital circuitry. The controller 40 receives signals from each of the capacitive sensors 32A-32D associated with a door handle and, based on the amplitude and pattern of the signals, such as a sum total or an average of the four signals, controls the door latch assembly 22 and door actuator 20 for that door. The controller 40 processes the input signal pursuant to a control routine 100 which may be executed by the microprocessor 40.

Figure 6:
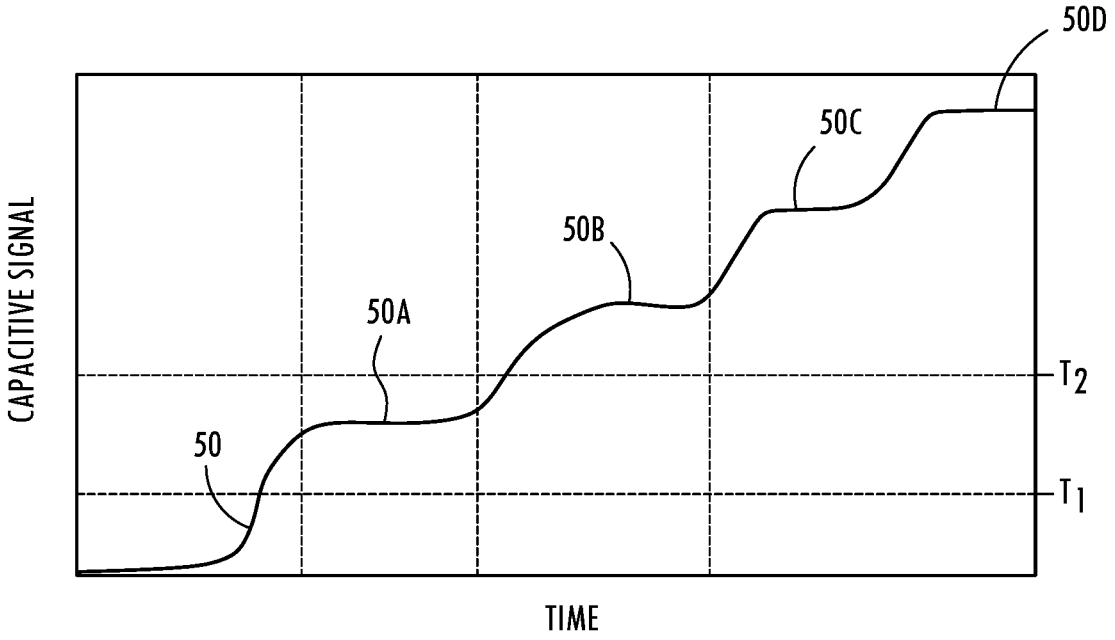
FIG. 6 is a signal diagram illustrating a signal generated with one of the proximity sensors when a user interfaces with the door handle to input variable speed door opening assist commands.

Referring to FIG. 6, one example of a signal generated by an average value of the four capacitive sensors is illustrated during a user input applied to the door handle in which the user sequentially moves the hand grip amongst a door unlatch command and three varying speed door opening commands. The signal amplitude is a function of the sensor count as a function of time and indicates the amount of contact area contacted on the contact surface. As a user's hand approaches the contact surface on the handle, a disruption in the sense activation field is realized which causes the signal to increase in amplitude.

The signal 50 is shown rising up during an initial contact of the user's hand with the contact surface and exceeding a first threshold $T_1$ which is a low threshold used to determine a door unlatch input. When the signal 50 is substantially level, such as shown by signal portion 50A above threshold $T_1$, the controller 40 may control the door latch to unlatch the door provided the user is determined to have door opening access such as being in possession of a key fob in close proximity to the door. The amplitude of the signal at signal portion 50A may be used to establish and store an initial signal level in memory. The signal 50 is further shown rising above a second higher threshold $T_2$ which is a threshold above which the signal must exceed in order to detect a speed control input for opening the door. The signal 50 rises up to a substantially stable signal on portion 50B above threshold $T_2$. If the signal 50 has increased by twenty percent (20%) over the initial signal level, a slow door open input is determined and the controller controls the actuator to open the door at a slow first speed. If the signal increases by forty percent (40%) over the initial signal as shown by portion 50C, the controller controls the actuator to open the door at a normal second speed which is greater than the first speed. If the signal increases by sixty percent (60%) or greater over the initial signal as shown by portion 50D, the controller controls the actuator to open the door at a faster third speed which is greater than the second speed. As such, the speed of the door opening can be controlled by the amount of force applied to the door handle which increases the amount of surface area of the hand on the contact surface as sensed by the proximity sensors.

Figure 7:
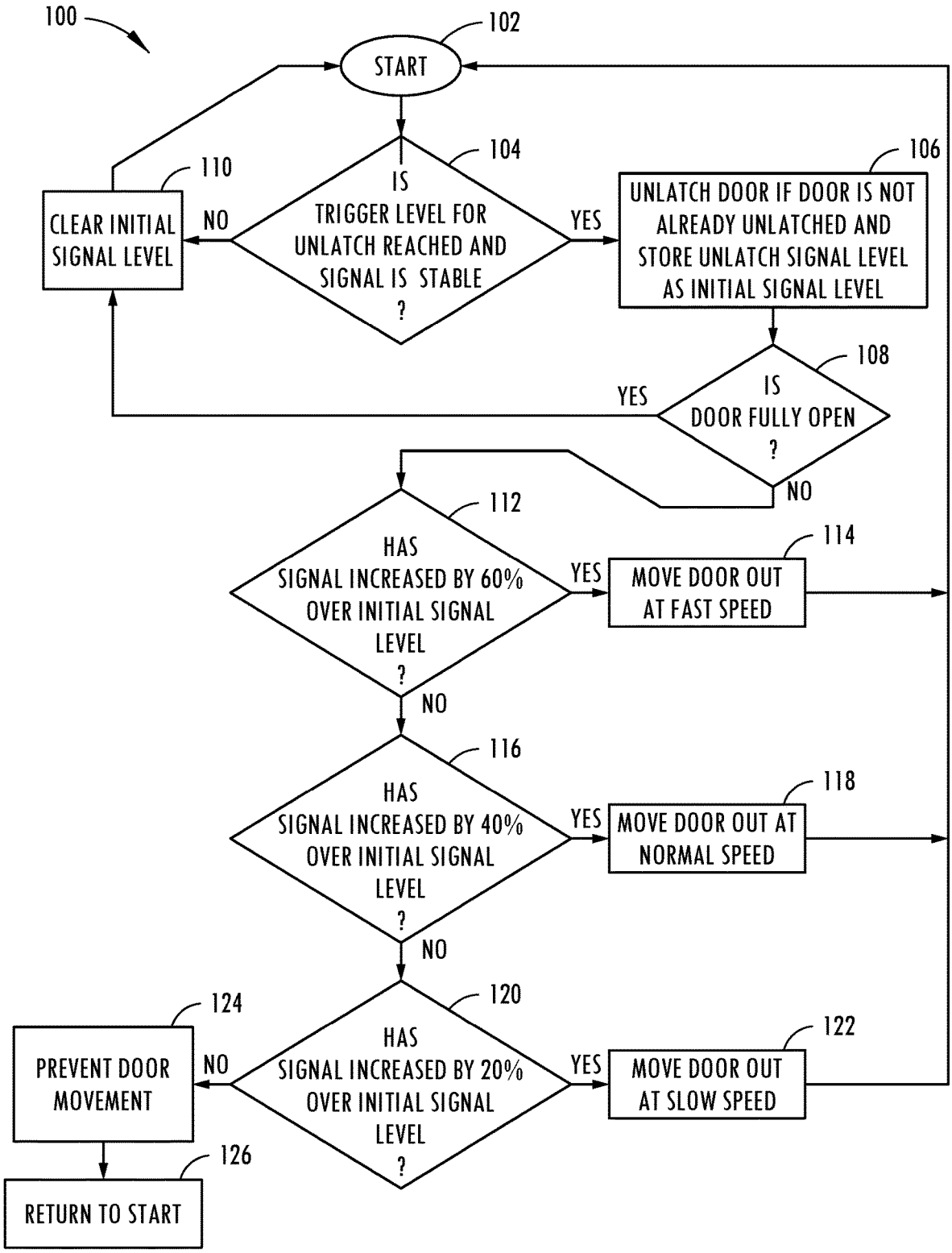
FIG. 7 is a flow diagram illustrating a routine for controlling the door latch and door/actuator opening speed with the powered door, according to one embodiment.

Referring to FIG. 7, a routine 100 for controlling the variable-speed power door is illustrated, according to one embodiment. Routine 100 begins at step 102 and proceeds to step 104 to determine if the trigger level for the unlatch is reached and if the signal is stable and, if not, clears the initial signal and returns to step 102. If the trigger level for the unlatch is reached and the signal is stable, routine 100 proceeds to step 106 to unlatch the door if the door is not already unlatched and to store the unlatch signal level as the initial signal level. Next, routine 100 proceeds to step 108 to determine if the door is fully open and, if so, proceeds to step 110 to clear the initial signal level before returning.

If the door is fully open, routine 100 proceeds to decision step 112 to determine if the signal has increased by sixty percent (60%) over the initial signal level and, if so, moves the door at the fast third speed before returning to step 102. Next, at decision step 116, routine 100 determines if the signal has increased by forty percent (40%) over the initial signal level and, if so, moves the door out at the normal second speed at step 118, before returning to step 102. Next, at decision step 120, routine 100 determines if the signal has increased by twenty percent (20%) over the initial signal level and, if so, moves the door out at the slow first speed at step 122 before returning to step 102. If the signal has not increased by twenty percent (20%) over the initial signal level, routine 100 proceeds to step 124 to prevent door movement and then returns to start at step 126.

Accordingly, it should be appreciated that the variable-speed powered door 12 advantageously controls the speed of the opening of the door based on varying levels of effort of a user applying force or contact onto a contact surface on the door handle. As such, the speed of opening of the door may be controlled which may be desirable, particularly when objects may be in front of the door or a user may be in a hurry to open a door. As a result, the powered door opening assist provides for enhanced door opening functionality.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A variable-speed powered door comprising:
- a door panel;
- a door handle located on the panel and having a contact surface;
- a proximity sensor arrangement located on the handle to sense a user's hand interfacing with the handle; and
- an actuator actuating the door panel to an open position at a speed that varies based on the sensed user hand contacting the contact surface, wherein the actuator actuates the door at a first speed when a first size contact area is sensed and at a greater second speed when a greater second size contact area is sensed.

2. The powered door of claim 1, wherein the actuator actuates the door at a third speed when a third size contact area is sensed.

3. The powered door of claim 1 further comprising a latch, wherein the latch is unlocked when an initial contact is sensed.

4. The powered door of claim 1 further comprising a controller configured to process one or more signals sensed by the one or more proximity sensors to detect the contact and control the actuator based on the detected contact.

5. The powered door of claim 1, wherein the proximity sensor comprises one or more capacitive sensors.

6. The powered door of claim 5, wherein the one or more capacitive sensors comprises a plurality of capacitive sensors.

7. The powered door of claim 1, wherein the proximity sensor is configured to sense contact on the contact surface on an inside surface of the handle.

8. The powered door of claim 1, wherein the door is located on a vehicle.

9. The powered door of claim 8, wherein the door handle is located on the exterior side of the door panel.

10. A vehicle door comprising:
- a door panel;
- a door handle located on the panel and having a contact surface;
- one or more proximity sensors located on the handle to sense a user's hand interfacing with the handle;
- an actuator for actuating the door panel; and
- a controller configured to control the actuator to open the door open position at a speed that varies based on the sensed user hand contacting the contact surface, wherein the actuator actuates the door at a first speed when a first contact area is sensed and at a greater second speed when a greater second size contact area is sensed.

11. The vehicle door of claim 10, wherein the actuator actuates the door at a third speed when a third size contact area is sensed.

12. The vehicle door of claim 10 further comprising a latch, wherein the latch is unlocked when an initial contact is sensed.

13. The vehicle door of claim 10, wherein the proximity sensor comprises one or more capacitive sensors.

14. The vehicle door of claim 13, wherein the one or more capacitive sensors comprises a plurality of capacitive sensors.

15. The vehicle door of claim 10, wherein the proximity sensor is configured to sense contact on the contact surface on an inside surface of the handle.

16. The vehicle door of claim 10, wherein the door is located on a motor vehicle.

17. The vehicle door of claim 16, wherein the door handle is located on the exterior side of the door panel.

18. The vehicle door of claim 10, wherein the controller is configured to process one or more signals sensed by the one or more proximity sensors to detect contact with the contact surface.

* * * * *